US007165417B2

(12) United States Patent
Operschall

(10) Patent No.: US 7,165,417 B2
(45) Date of Patent: Jan. 23, 2007

(54) CONDENSER RECEIVER WITH INSERT

(75) Inventor: Norbert Operschall, Oberwaltersdorf (AT)

(73) Assignee: Modine Manufacturing Company, Racine, WI (US)

( * ) Notice: Subject to any disclaimer, the term of this patent is extended or adjusted under 35 U.S.C. 154(b) by 189 days.

(21) Appl. No.: 10/940,040

(22) Filed: Sep. 14, 2004

(65) Prior Publication Data

US 2005/0072184 A1 Apr. 7, 2005

(30) Foreign Application Priority Data

Oct. 2, 2003 (DE) ..... 103 45 921

(51) Int. Cl.
*F25B 43/00* (2006.01)

(52) U.S. Cl. ..... 62/474

(58) Field of Classification Search ..... 62/474, 62/509, 305, 512; 165/110, 132, 173–176; 55/518; 96/108
See application file for complete search history.

(56) References Cited

U.S. PATENT DOCUMENTS 3,051,450 A * 8/1962 White et al. ..... 165/110
5,159,821 A * 11/1992 Nakamura ..... 62/509
5,228,315 A 7/1993 Nagasaki et al.
5,379,833 A * 1/1995 Mathews ..... 165/113
5,419,141 A * 5/1995 Burk ..... 62/474
5,505,253 A * 4/1996 Heraud ..... 165/110
5,546,761 A * 8/1996 Matsuo et al. ..... 62/509
5,582,027 A * 12/1996 Baba et al. ..... 62/509
5,709,106 A 1/1998 Annaba et al.
5,713,217 A * 2/1998 Baba ..... 62/509
5,868,002 A * 2/1999 Matsubayashi ..... 62/507
5,875,650 A 3/1999 Nobuta et al.
5,896,754 A 4/1999 Balthazard et al.
6,000,465 A 12/1999 Kawahara
6,038,884 A 3/2000 Dabrowski
6,374,632 B1 * 4/2002 Nobuta et al. ..... 62/509
6,468,334 B2 10/2002 Incorvia et al.
6,470,704 B2 * 10/2002 Shibata et al. ..... 62/509
6,589,320 B2 7/2003 Incorvia et al.
6,694,773 B1 * 2/2004 Snow et al. ..... 62/510
6,698,235 B2 * 3/2004 Nobuta et al. ..... 62/509
2004/0031285 A1 2/2004 Altendorfer et al.

FOREIGN PATENT DOCUMENTS

DE 198 30 329 A1 1/1999
DE 10221968 A1 * 11/2003
EP 1 363 089 A1 3/2003
JP 2001-255042 A * 9/2001

* cited by examiner

*Primary Examiner*—Mohammad M. Ali
(74) *Attorney, Agent, or Firm*—Wood, Phillips, Katz, Clark & Mortimer

(57) ABSTRACT

A receiver for a vehicle air conditioner having a pair of headers and a plurality of tubes defining a plurality of refrigerant flow stages between the headers. The receiver includes a housing in refrigerant flow connection with one of the condenser headers, and a receiving device removably secured in the housing. The device includes first and second members sealing against the receiver to define respective spaced first and second walls, and at least one connection line is in or on the receiving device and bridges the spacing between the first and second walls, with the connection line being adapted to guide refrigerant through the spacing from one stage to another stage. Desiccant is provided in the housing between the first and second sealing members.

18 Claims, 2 Drawing Sheets

CONDENSER RECEIVER WITH INSERT

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a receiver for a condenser, and more particularly to a receiver and insert for an air conditioner for vehicles.

BACKGROUND OF THE INVENTION AND TECHNICAL PROBLEMS POSED BY THE PRIOR ART

Receivers for refrigerant of vehicular condensers are shown, for example, in European patent application EP 03 004 717.9, which is conceived for use in the header of condensers in which the refrigerant flows through the condenser in several streams in the opposite direction. The streams form zones or stages that are often referred to as condensation zones or subcooling zones, depending on the purpose. In one such known condenser, one or more condensation zones are on the top and one subcooling zone is on the bottom. The receiving device for such condensers cannot be, however, be used when the arrangement of the zones or the flow path of the condenser must be altered for specific reasons.

Condensers with other, different flow paths are known, for example, from U.S. Pat. No. 5,228,315. In order to implement the flow paths shown there, the design of a header was equipped with the corresponding collector in one piece with several channels, which results in a significant (i.e., very demanding) change of the entire condenser if another flow path is desired.

The condenser known from DE 198 30 329 A1 behaves similarly. The header and the collector there have a bead extending over the length of their connection, providing a connection line for the refrigerant.

Kawahara U.S. Pat. No. 6,000,465 discloses a heat exchanger with a receiver structure attachable to the side thereof. The receiver is a fixed structure, whereby completely different receivers must be manufactured for use with heat exchangers having different flow requirements.

Dabrowski U.S. Pat. No. 6,038,884 discloses an air conditioning condenser with an exchangeable fluid reservoir. The reservoir is secured at its bottom to a base, with flow in and out of the reservoir passing through that bottom base. Inaba et al. U.S. Pat. No. 5,709,106 discloses a condenser structure having a liquid tank which, similar to Dabrowski '884, is secured alongside its bottom to a base with flow in and out of the tank passing through that bottom base.

Incorvia et al. U.S. Pat. Nos. 6,468,334 B2 and 6,589,320 B2 disclose a condenser with a receiver, where liquid pools in the bottom of the receiver from which it may pass to the bottom refrigerant tubes of a supercooling core. An absorbent cartridge is located in the top of the receiver, and includes fluted channels on the outer surface of the cartridge housing, permitting refrigerant flow up and around the outside of the cartridge to the porous end member at its upper end.

Balthazard et al. U.S. Pat. No. 5,896,754 discloses a condenser with reservoirs built into the manifolds, where the reservoirs include beading or partitions on their outer surface to define flow pass partitions in the manifold. Flow enters and leaves the reservoir through outlet and inlet openings near the bottom of the reservoir.

The present invention is directed toward overcoming one or more of the problems set forth above.

SUMMARY OF THE INVENTION

In one aspect of the present invention, a desiccant receiving device is provided for a vehicle air conditioner having a condenser with at least one header and a plurality of tubes defining a plurality of refrigerant flow stages. The receiving device is adapted for mounting in a receiver in refrigerant flow connection with the one condenser header, and the device includes at least one member sealing against the receiver to define a first wall between sections of the receiver and at least one connection line in or on the receiving device. The connection line is adapted to guide refrigerant therethrough from one stage to another stage.

In one form of this aspect of the invention, the device is adapted for removable mounting in the receiver.

In another form of this aspect of the invention, the direction of refrigerant flow in the connection line is opposite the refrigerant flow direction in the receiver outside of the connection line.

In still another form of this aspect of the invention, a second sealing member defines a second wall spaced from the defined first wall, and the connection line bridges the spacing between the sealing members. In further forms, desiccant is in the receiver and between the first and second sealing members, or a perforated wall us between the first and second sealing members wherein the connection line is between the perforated wall and the desiccant, or the first and second sealing members each have an opening therethrough with the connection line being a tube extending through the sealing member openings, or one end of the connection line extends beyond one of the sealing members and the other end is sealed to the other sealing member. In another further form, the first and second sealing members each include a sealing wall having a periphery sealing around the inner wall of the receiver and, in a still further form, the wall defined by the one sealing member is generally parallel to the wall defined by the second sealing member. In yet another further form, a filter basket is secured to one of the sealing members, and the filter basket and one sealing member are releasably connected to the receiving device.

In still other forms of this aspect of the invention, the connection line is a riser or a downcomer.

In yet another form of this aspect of the invention, the connection line is integrated in the receiving device.

In yet a further form of this aspect of the invention, the receiving device is fastened with one end to a closure cover of the receiver.

In another aspect of the present invention, a receiver is provided for a vehicle air conditioner having a condenser with a pair of headers and a plurality of tubes defining a plurality of refrigerant flow stages between the headers. The receiver includes a housing in refrigerant flow connection with one of the condenser headers, and a receiving device removably secured in the housing. The device includes a first member sealing against the receiver to define a first wall between sections of the receiver, a second member sealing against the receiver to define a second wall spaced from the first wall, and at least one connection line in or on the receiving device and bridging the spacing between the first and second walls, with the connection line being adapted to guide refrigerant through the spacing from one stage to another stage. Desiccant is provided in the housing between the first and second sealing members.

In one form of this aspect of the present invention, the direction of refrigerant flow in the connection line is opposite the refrigerant flow direction in the receiver outside of the connection line.

In another form of this aspect of the present invention, the first and second sealing members each have an opening therethrough, and the connection line is a tube extending through the sealing member openings.

In still another form of this aspect of the present invention, one end of the connection line extends beyond one of the sealing members and the other end is sealed to the other sealing member.

In yet another form of this aspect of the present invention, the receiving device is fastened with one end to a closure cover of the receiver.

In yet a further form of this aspect of the present invention, a filter basket is secured to one of the sealing members, with the filter basket and one sealing member being releasably connected to the receiving device.

In still another aspect of the present invention, a receiver is provided for a vehicle air conditioner having a condenser with a pair of headers and a plurality of tubes defining a plurality of refrigerant flow stages between the headers. The receiver includes a housing in refrigerant flow connection with one of the condenser headers, and a receiving device removably secured in the housing. The device includes a first member sealing against the receiver to define a first wall between sections of the receiver, and at least one connection line in or on the receiving device and extending through the first wall, with the connection line being adapted to guide refrigerant through the first sealing member from one stage to another stage. Desiccant is also provided in the housing.

DETAILED DESCRIPTION OF THE INVENTION

The Figures show a practical example of a receiving device 10 according to the present invention, in which a collector or receiver 14 is arranged on one of the two headers 16 of the condenser 20 (see FIG. 5) of the air conditioner of a vehicle. (It is well known that heat exchangers may be manufactured in a variety of ways in which the fluid flow between the multiple tubes of the heat exchanger is confined by different structures, including tanks secured to headers, and pipe structures and collector tubes mounted to the tubes. While reference is made herein to header constructions, it should be understood that the present invention may be used with not only header and tank configurations but also such other structures and that references herein to headers, including in the claims, is intended to refer to such other structures.)

Figure 5:
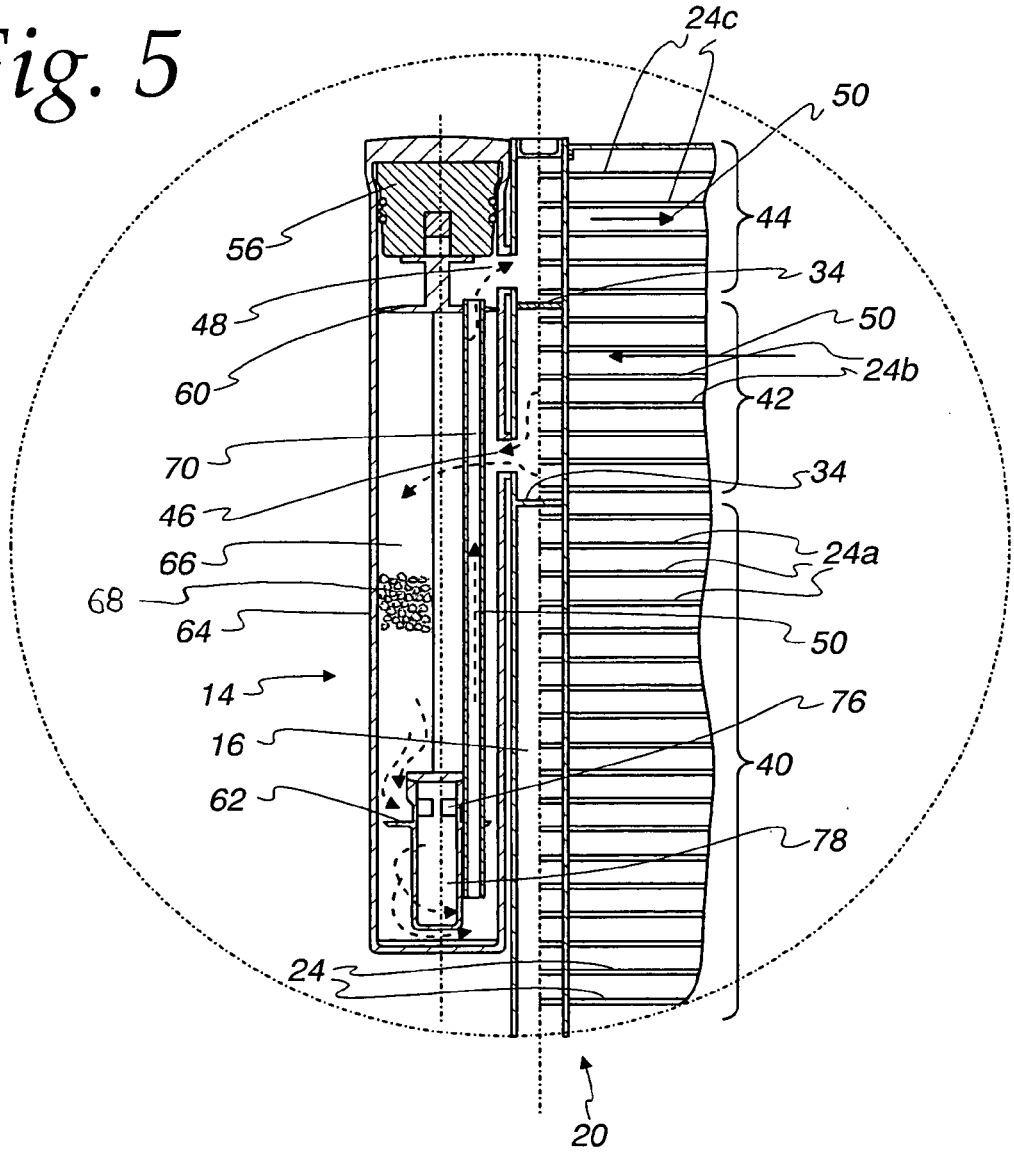
FIG. 5 is a cutout of a portion of a condenser having a receiver in which the receiving device of FIGS. 1–4 is used.

In the illustrated embodiment, the condenser 20 includes a plurality of tubes 24 defining suitable flow paths for fluid such as is known in the art. Suitable headers 30 are provided on opposite ends of the tubes 24 (only one header 30 is shown in FIG. 5) such as is also known to provide a path for flow of fluid to and from the tubes 24. It should be understood, however, that it is of subordinate significance in the present context whether the header 16 and collector 14 are designed in one piece or assembled from two tubes, as shown in FIG. 5.

Also in the illustrated embodiment, the condenser outlet (not shown) is on the header (also not shown) on the other side of the condenser 20.

Suitable ribs or fins (not shown) are also provided between the tubes to facilitate cooling such as is also known in the art, for example, by the flow of cooling air over the fins and between the tubes 24. It would be within the scope of the present invention to use any suitable fins, including serpentine or corrugated fins and plate fins.

Suitable partitions 34 (two of which are shown in FIG. 5) may also be provided as desired to direct fluid through separate passes or stages 40, 42, 44 of the condenser 20. For example, as illustrated in FIG. 5, coolant or refrigerant will flow from the header 30 into the tubes 24*a* of the bottom pass(es) 40, then flow from the tubes 24*a* through the other header and into the tubes 24*b* of pass 42, then flow from the tubes 24*b* through the header 30 and (as described in greater detail hereafter) on to the overlying stage 44 which, in the illustrated embodiment, is a subcooling stage. One or more passes/stages may be provided beneath pass(es) 40 illustrated in FIG. 5.

In accordance with the present invention, it is important that the collector 14 be in flow connection with the header 16 so that it can be traversed by the refrigerant. As illustrated in FIG. 5, the refrigerant exiting tubes 24*b* flows through an inflow opening 46 into the collector 14, and refrigerant exits the collector 14 through outflow opening 48. It should be appreciated, however, that several inflow and outflow openings 46, 48 can naturally be present.

Flow arrows 50 show the flow directions of the refrigerant in the condenser 20 and through its collector 14.

The receiving device 10 is suitably secured in the collector 14, for example by a threaded head 56 with a suitable seal, where the threaded head 56 forms a closure cover for the receiving device 10. The receiving device 10 may therefore be easily removed and or replaced for maintenance and/or conversion to differently configured receiving devices 10.

The illustrated receiving device 10 includes a pair of spaced sealing walls 60, 62 along its length which each have an outer sealing wall 64 which essentially seals against the inner wall 64 of the collector 14 to block refrigerant flow past the sealing wall 60, 62. A space 66 is therefore defined between the two sealing walls 60, 62 which may advantageously be at least partly filled with a suitable desiccant 68 to remove unwanted water from the refrigerant passing therethrough.

Figure 2:
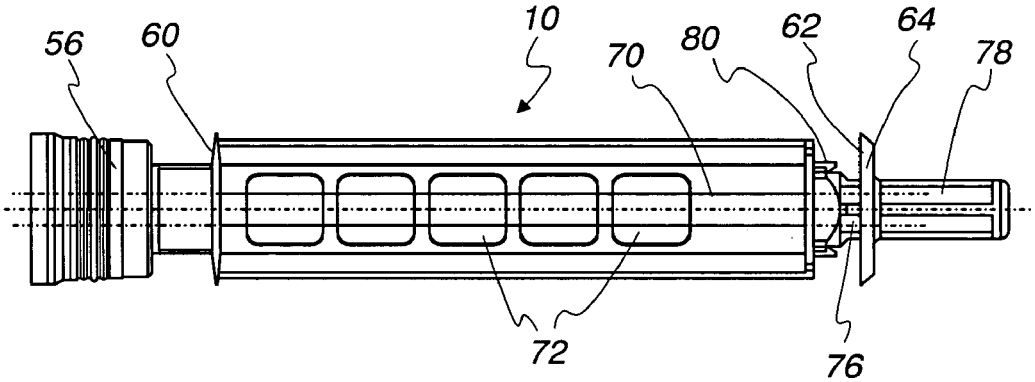
FIG. 2 is one side view of the receiving device of FIG. 1.
Figure 3:
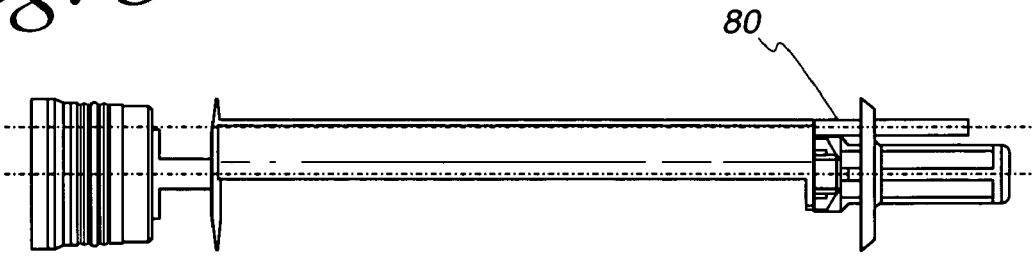
FIG. 3 is another side view of the receiving device of FIG. 1, with the receiving device turned 90 degrees.
Figure 4:
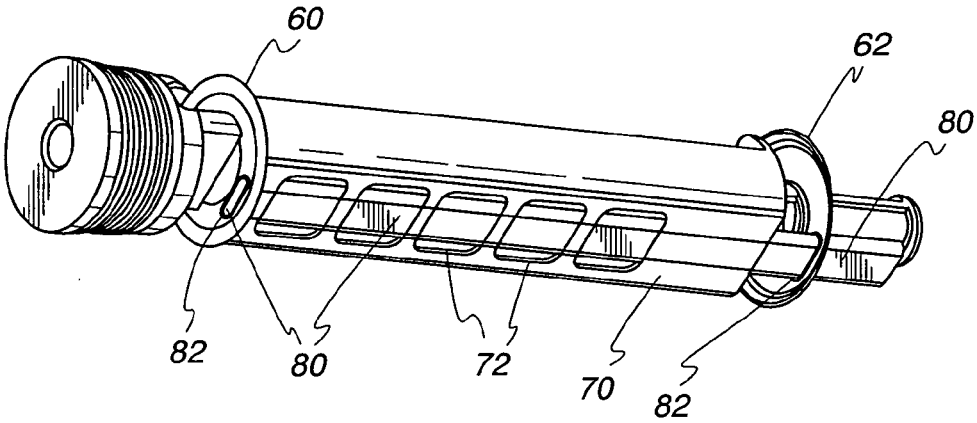
FIG. 4 is a perspective view of the receiving device of FIG. 1.

Since the path above the inflow opening 46 is blocked by the sealing wall 60, the refrigerant from inflow opening 46 will propagate downward and then in contact with the desiccant in the space 66. As shown in FIGS. 2 and 4, the wall 70 of the receiving device 10 is perforated, with several perforations 72 drawn in the wall 70 so that advantageous contact of the refrigerant with the desiccant may be achieved.

Flow openings 76 through which the refrigerant can flow in and through a filter basket 78 are situated above the second sealing wall 62, after which, cleaned of undesired components, the refrigerant is situated beneath the sealing wall 62. In the illustrated embodiment, the filter basket 78 and sealing wall 62 form a unit releasably connected to the receiving device 10.

A connection line or tube 80 is integrated into the receiving device 10. An opening 82 is situated in the lower sealing wall 64 through which, during assembly of the filter basket 78 with the sealing wall 62 on the receiving device 10, the end of the connection tube 80 is pushed through. Alternatively, a connection tube 80 could also be pushed as an individual part through axially aligned openings 82 in both sealing walls 60, 62.

The connection line 80 may alternatively be unreleasably integrated in the receiving device 10, for example, by manufacturing the receiving device 10 and connection line 80 uniformly from plastic. In this case, it has proven advantageous that one sealing member 62 and the filter basket 78 be designed as a common single part releasably connected to the receiving device 10.

Figure 1:
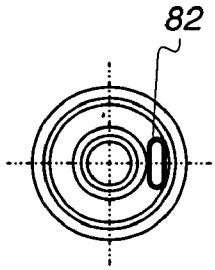
FIG. 1 is a top view of a receiving device embodying the present invention.

From the filter basket 78 beneath the sealing wall 62, the refrigerant flows upward through the connection tube 80 which extends between axially aligned holes 82 (see FIGS. 1 and 4) in the sealing walls 60, 62. (In the embodiment illustrated in FIGS. 1–5, the connection line 80 clearly extends beyond the sealing wall 60 on one end and is closed off on the other end, but it should be understood that this is due merely to the particular embodiment and it should be understood that such an extension of the connection tube 80 is not essential to the present invention.)

While the connection tube 80 in the above described embodiment is a riser, with refrigerant flow occurring up through the tube 80 to the space above the upper sealing wall 60 then to the outflow opening 48 into the subcooling stage 44 of the condenser 20, the connection tube 80 according to other practical examples can alternatively be a line which guides the refrigerant from an upper stage to an underlying or lowermost stage of the condenser. Such connection tubes 80 are then referred to as downcomers merely to clarify the difference relative to the depicted riser.

In addition, the present invention envisions still other variants in which, for example, several connection lines or tubes may be provided in connection with several sealing walls in order to correspond to other desired flow paths of the condenser in a cost-effective way.

It should be appreciated that the present invention facilitates the manufacture of condensers with receivers having a variety of flow paths. Different configuration receiving devices according to the present invention may be readily provided to accommodate a wide variety of flow configurations without requiring further costly redesign and manufacture of the entire condenser/receiver structure. Moreover, receivers according to the present invention may be implemented very cost-effectively with relatively few changes to most condenser designs, with the required changes essentially being only insertion of the partitions in the condenser header and mounting of the corresponding inflow and outflow openings.

It should further be appreciated that, as illustrated in the embodiment shown in the figures, the present invention may be readily used in which a subcooling stage or zone may be situated on top, notwithstanding the desire for only liquid in the subcooling stage, where liquid is, of course, typically separated out from gaseous refrigerant at the bottom.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A desiccant receiving device for a vehicle air conditioner having a condenser with at least one header and a plurality of tubes defining a plurality of refrigerant flow stages, said device being adapted for mounting in a receiver in refrigerant flow connection with said one condenser header, and said device including at least one member sealing against said receiver to define a first wall between sections of said receiver, a second sealing member defining a second wall spaced from the defined first wall, said first and second sealing members each have an opening therethrough, and at least one refrigerant connection line in or on the receiving device, said connection line including a tube extending through said sealing member openings and bridging the spacing between said sealing members and adapted to guide refrigerant therethrough from one stage to another stage.

2. The receiving device of claim 1, wherein the direction of refrigerant flow in said connection line is opposite the refrigerant flow direction in the receiver outside of the connection line.

3. The receiving device of claim 1, wherein said device is adapted for removable mounting in the receiver.

4. The receiving device of claim 1, further comprising a filter basket secured to one of said sealing members, said filter basket and one sealing member being releasably connected to the receiving device.

5. The receiving device of claim 1, further comprising desiccant in the receiver and between the first and second sealing members.

6. The receiving device of claim 1, further comprising a perforated wall between said first and second sealing members, wherein the connection line is between the perforated wall and the desiccant.

7. The receiving device of claim 1, wherein one end of the connection line extends beyond one of the sealing members and the other end is sealed to the other sealing member.

8. The receiving device of claim 1, wherein the first and second sealing members each include a sealing wall having a periphery sealing around the inner wall of the receiver.

9. The receiving device of claim 8, wherein the wall defined by said one sealing member is generally parallel to the wall defined by said second sealing member.

10. The receiving device of claim 1, wherein the connection line is a riser.

11. The receiving device of claim 1, wherein the connection line is a downcomer.

12. The receiving device of claim 1, wherein the connection line is integrated in the receiving device.

13. The receiving device of claim 1, wherein the receiving device is fastened with one end to a closure cover of the receiver.

14. A receiver for a vehicle air conditioner having a condenser with at least one header and a plurality of tubes defining a plurality of refrigerant flow stages, said receiver including:

a housing in refrigerant flow connection with said at least one condenser header;

a receiving device removably secured in said housing, said device including a first member sealing against said receiver to define a first wall between sections of said receiver and having an opening therethrough, a second member sealing against said receiver to define a second wall spaced from said first wall and having an opening therethrough, and at least one connection line in or on the receiving device including a tube extending through said sealing member openings and bridging the spacing between said first and second walls, said connection line being adapted to guide refrigerant through the spacing from one stage to another stage; and desiccant in the housing between the first and second sealing members.

15. The receiver of claim 14, wherein the direction of refrigerant flow in said connection line is opposite the refrigerant flow direction in the receiver outside of the connection line.

16. The receiver of claim 14, wherein one end of the connection line extends beyond one of the sealing members and the other end is sealed to the other sealing member.

17. The receiver of claim 14, wherein the receiving device is fastened with one end to a closure cover of the receiver.

18. The receiver of claim 14, further comprising a filter basket secured to one of said sealing members, said filter basket and one sealing member being releasably connected to the receiving device.

* * * * *